US006672570B2

(12) United States Patent
Takano et al.

(10) Patent No.: US 6,672,570 B2
(45) Date of Patent: Jan. 6, 2004

(54) VARIABLE VENTURI CARBURETOR

(75) Inventors: Jun Takano, Miyagi-ken (JP); Hitoshi Terakado, Sendai (JP); Giovanni Vimercati, Bologna (IT)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 10/054,073

(22) Filed: Nov. 13, 2001

(65) Prior Publication Data

US 2002/0113326 A1 Aug. 22, 2002

(30) Foreign Application Priority Data

Nov. 17, 2000 (JP) ..... 2000-350536
Nov. 17, 2000 (JP) ..... 2000-350537

(51) Int. Cl.[7] ..... F02M 1/10

(52) U.S. Cl. ..... 261/39.2; 261/39.4; 261/44.3; 261/44.4; 261/44.8; 261/DIG. 8; 261/DIG. 74

(58) Field of Search ..... 261/44.3, 44.4, 261/44.8, 39.2, 39.4, DIG. 8, DIG. 73, DIG. 74

(56) References Cited

U.S. PATENT DOCUMENTS 3,689,036 A * 9/1972 Kikuchi et al. ..... 261/34.2
3,765,658 A * 10/1973 Hartel et al. ..... 261/41.5
4,150,070 A * 4/1979 Hashimoto et al. ..... 261/41.4
4,268,462 A * 5/1981 Ota et al. ..... 261/40
4,290,399 A * 9/1981 Takada et al. ..... 123/439
4,372,276 A * 2/1983 Bernhardsson et al. ..... 123/525
4,446,080 A * 5/1984 Karino et al. ..... 261/39.5
4,499,032 A * 2/1985 Shibano ..... 261/72.1
4,505,250 A * 3/1985 Hada et al. ..... 123/540
4,506,644 A * 3/1985 Katou et al. ..... 123/439
4,620,951 A * 11/1986 Makino et al. ..... 261/44.3
4,627,401 A * 12/1986 Brandner et al. ..... 123/439
4,862,847 A * 9/1989 Kobayashi et al. ..... 123/179.9
5,258,143 A * 11/1993 Wang ..... 261/44.3
5,427,719 A * 6/1995 Oshima ..... 261/44.3
5,648,023 A * 7/1997 Nojima ..... 261/44.4
5,707,560 A * 1/1998 Nevin ..... 261/44.4
5,720,906 A * 2/1998 Yamanaka et al. ..... 261/35
5,988,602 A * 11/1999 Yokoyama et al. ..... 261/35

FOREIGN PATENT DOCUMENTS

JP 54-50728 * 4/1979
JP 60-69253 * 4/1985
JP 60-90968 * 5/1985
JP 60-95173 * 5/1985
JP 60-184954 * 9/1985
JP 62-288353 * 12/1987
JP 3-202665 * 9/1991

* cited by examiner

*Primary Examiner*—Richard L. Chiesa
(74) *Attorney, Agent, or Firm*—Reising, Ethington, Barnes, Kisselle, P.C.

(57) ABSTRACT

A variable venturi carburetor for a combustion engine has an uprighted cup-shaped piston head which forms an integral part of a venturi within a fuel-and-air mixing passage carried by a carburetor body, and a needle that projects rigidly downward from the head into a fuel feed passage. The position of the piston head controls air flow by adjusting the air flow cross-section of the variable venturi, and the needle simultaneously controls fuel flow into the fuel-and-air mixing passage at the venturi via obstruction of the fuel feed passage. The piston head and needle move in unison by a flexible diaphragm engaged to and disposed above the head. An atmospheric chamber is defined below the diaphragm and a vacuum chamber is defined generally above the diaphragm. A vacuum passage extends through the bottom of the head communicating between the fuel-and-air mixing passage at the venturi and the vacuum chamber. As vacuum at the venturi increases, the volume of the vacuum chamber decreases and the flexing diaphragm moves the head partially out of the fuel-and-air mixing passage until a balance of forces between the vacuum draw and the resilient compression of a spring disposed within the vacuum chamber and which biases the head into the passage is reached. During cold engine starts, cold idling, and cold acceleration, a cold engine priming device sensing the temperature of the engine and delivers additional fuel into the fuel-and-air mixing passage from a fuel chamber when the engine is below a pre-set value.

10 Claims, 3 Drawing Sheets

VARIABLE VENTURI CARBURETOR

REFERENCE TO RELATED APPLICATIONS

Applicants claim priority of Japanese patent applications Serial No. 2000-350536, filed Nov. 17, 2000, and Serial No. 2000-350537, filed Nov. 17, 2000.

FIELD OF THE INVENTION

This invention relates to a carburetor, and more particularly to a variable venturi carburetor having a fuel priming cold start device.

BACKGROUND OF THE INVENTION

In a conventional carburetor a fuel-and-air mixing passage extends usually horizontally through a carburetor body providing a fuel-and-air mixture to the crankcase of a combustion engine. A throttle valve or plate in the passage and near the passage outlet is supported by a shaft carried by the body and extending transversely through the passage, pivots within the passage to control the fuel-and-air mixture flow, which in-part controls the revolutions per minute, rate, of an operating engine. Similarly, a pivoting choke plate is supported within the passage by the body to control the amount of air flow through a venturi with a fixed cross-sectional area disposed in the passage between the throttle and choke plates. A main fuel feed tube communicates transversely into the fuel-and-air mixing passage to emit liquid fuel into the passage for mixing with air. The amount of emitted liquid fuel is dependent upon the amount of vacuum created at the venturi by the operating engine. Typically, for engine idle conditions, a separate fuel nozzle is provided at or near the throttle plate and the main fuel feed tube is reserved for higher speed engine operating conditions.

Unfortunately, for cold engine starts, cold idle and cold acceleration, the operating engine requires a richer or higher ratio of fuel-to-air to start and operate smoothly. Providing the proper additional amounts of fuel for varying air flow amounts for different engine transients (i.e. cranking, idle, and acceleration) is difficult. Often, providing the proper ratio of fuel and air for cold idle conditions will lead to an engine stall during cold acceleration. Furthermore, providing the proper ratio of fuel while maintaining emission performance standards is also difficult.

SUMMARY OF THE INVENTION

A variable venturi area carburetor for a combustion engine has an uprighted cup-shaped piston head which forms an integral part of a venturi within a fuel-and-air mixing passage carried by a carburetor body, and a needle that projects rigidly downward from the head into a fuel feed passage that communicates with a fuel chamber at atmospheric pressure. The position of the piston head controls air flow by adjusting the air flow cross-sectional area of the variable venturi, and the needle simultaneously controls fuel flow into the fuel-and-air mixing passage at the venturi via obstruction of the fuel feed passage. The piston head and needle are moved in unison by a flexible diaphragm engaged to and disposed above the head. An atmospheric chamber is defined below the diaphragm and a vacuum chamber is defined generally above the diaphragm. A vacuum pressure passage extends through the bottom of the head communicating between the fuel-and-air mixing passage at the venturi and the vacuum chamber. As vacuum at the venturi increases, the volume of the vacuum chamber decreases and the flexing diaphragm moves the head partially out of the fuel-and-air mixing passage until a balance is reached of forces produced by the vacuum acting on the diaphragm and a resilient compression spring disposed within the vacuum chamber which biases the head into the passage. Retraction of the piston head is opposed by the spring force to increase the magnitude of the vacuum produced by the venturi and thereby creating a rich mixture of fuel-and-air when required. During cold engine starts, cold idling, and cold acceleration, a cold engine priming device senses the temperature of the engine and delivers additional fuel into the fuel-and-air mixing passage from a fuel chamber when the engine temperature is below a pre-set value.

Objects, features, and advantages of this invention include a variable venturi type carburetor which provides an increased quantity of fuel to the fuel-and-air mixing passage when a cranking or running engine is below an optimum running temperature without operator intervention. Another advantage of the present invention is a reliable, robust and relatively inexpensive to manufacture carburetor that causes an engine to start, idle and accelerate smoothly and reliably at cold temperatures without requiring a traditional choke plate or valve.

DESCRIPTION OF THE DRAWINGS

These and other objects, features and advantages of this invention will be apparent from the following detailed description, appended claims, and accompanying drawings in which:

DETAILED DESCRIPTION OF THE PREFERRED EMBODIMENTS

Figures 1, 2:
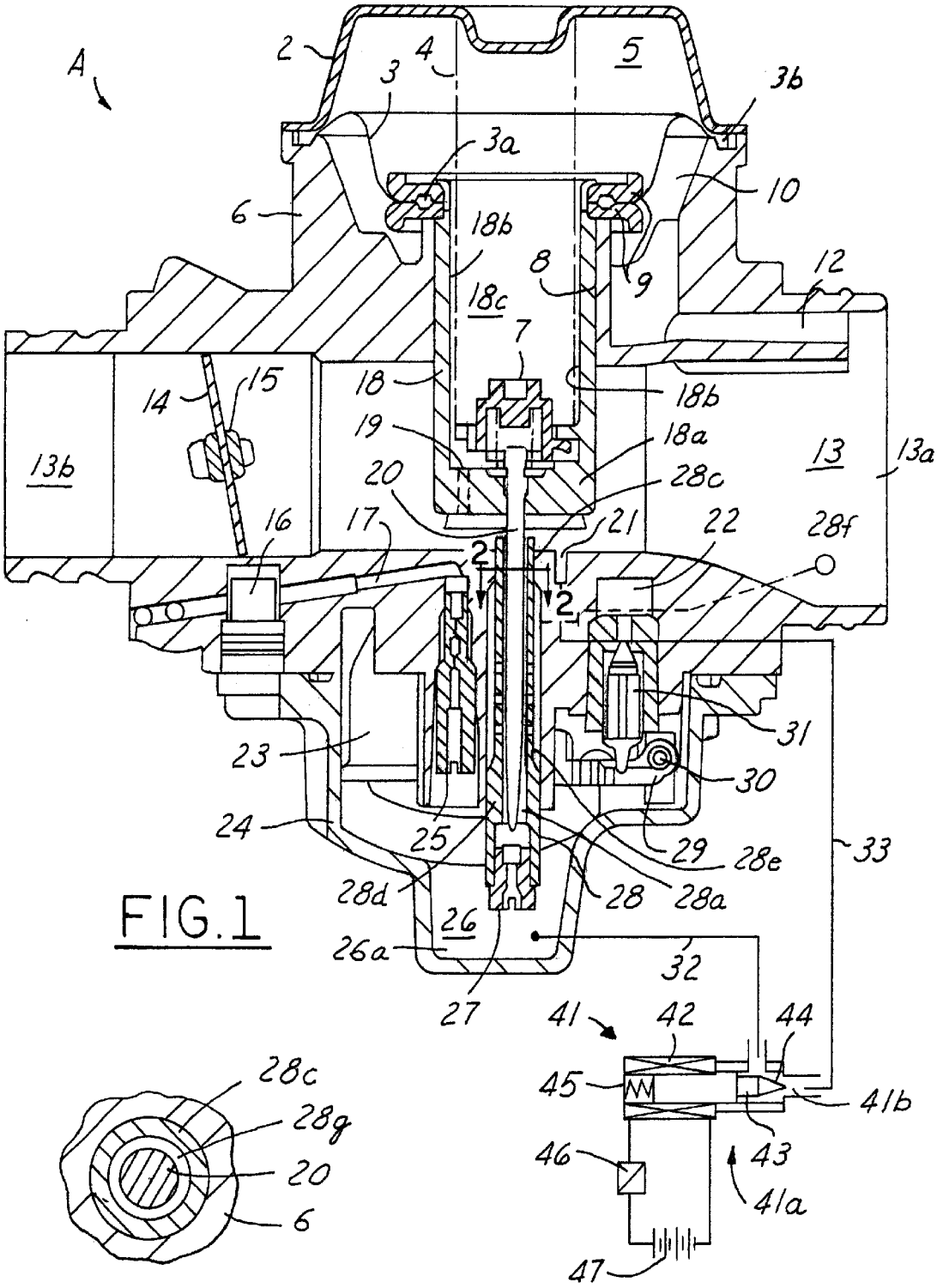
FIG. 1 is a part diagrammatic and a side sectional view of a variable venturi carburetor having a cold-start fuel priming device of the present invention.
FIG. 2 is a fragmentary cross-sectional view of the variable venturi carburetor illustrating a cross section of a needle and fuel feed tube when in an open position taken along line 2—2 of FIG. 1.

Referring in more details to the drawings, FIG. 1 illustrates a variable venturi carburetor (A) embodying with the present invention. Air flows into the carburetor (A) from an air filter (not shown) at an inlet 13*a* of a fuel-and-air mixing passage 13 which extends longitudinally through and is defined by a body 6 of the carburetor (A). From the inlet 13*a*, the filtered air travels through a variable venturi created by an obstruction or movable upright cup shaped piston head 18 where it mixes with a rich mixture of fuel-and-air emitted from a fuel feed tube 28 during high engine running conditions. The piston head 18 is slidably received in a bore 8 and is movable in a substantially linear fashion transversely into and out of the fuel-and-air mixing passage 13 thereby adjusting the cross sectional flow area at the effective venturi location of the carburetor (A). The resultant fuel-and-air mixture flows through a butterfly type throttle valve 14 having a rotatable shaft 15 supported by the body 6 and extending transversely through the fuel-and-air mixing passage 13 between the piston head 18 and an outlet 13*b* of the fuel-and-air mixing passage 13 leading to an intake manifold of a combustion engine, not shown.

Fuel is supplied to the fuel-and-air mixing passage 13, during hot idle conditions of the engine, through a fuel idle passage 17. Passage 17 communicates between an idle fuel nozzle 16 disposed just upstream of the throttle valve 14 when the valve is substantially closed and a jet screw 25 disposed at the opposite end which communicates with a fuel reservoir or chamber 26 carried beneath the carburetor body 6 and defined by the body 6 and a fuel bowl 24 engaged to the underside of body 6.

Preferably, the carburetor is a float type and the fuel reservoir 26 contains a float 23 with an arm 29 which projects from the float 23 and is supported pivotally at an opposite end by a shaft 30 carried by the fuel reservoir wall 24. A fuel inlet valve or head 31 bears on an intermediate part of the pivoting arm 29 so that as the arm 29 pivots down and up the inlet valve 31 opens and closes the end of a passage communicating with a fuel inlet 22 for receiving liquid fuel from a remote fuel tank, not shown. When the fuel level of the fuel chamber 26 lowers, the float 23 moves downward so that the inlet valve 31 is opened by the arm 29 or moves away from its valve seat and liquid fuel from the inlet 22 flows into the fuel chamber 26. When the fuel level within the fuel chamber 26 increases the float 23 moves up so that the inlet valve 31 is moved up by the arm 29 until the fuel inlet 32 is blocked or closed by the valve bearing on its seat. The present invention is not limited to a float type carburetor chamber 26 and can be a fuel chamber of a diaphragm type carburetor which is common in smaller two stroke combustion engines.

The piston head 18, which sealably fits and slides within a cylinder bore 8 defined by a wall 8*a* of the carburetor body 6, is biased into the fuel-and-air passage 13 via a spring 4 and moves transversely in and out of the fuel-and-air mixing passage 13 via a pressure differential acting on the diaphragm 3. When air flows through the fuel-and-air mixing passage 13 beneath the protruding bottom portion 18*a* of the piston head 18, a venturi effect is created producing a low pressure pocket or vacuum which is introduced into a vacuum chamber 5 via a vacuum passage 19 which communicates with the fuel-and-air mixing passage 13 through the bottom portion 18*a* of the piston head 18.

When the engine is running, actuation or retraction of the piston head 18 occurs when the throttle valve 14 opens to increase fuel and air flow to the engine. The increase in air flow creates an increase in the venturi induced vacuum beneath the head 18. This vacuum increase is applied to the vacuum chamber 5 and acts on the diaphragm 3 to move the head 18 upward against the resilient force of spring 4 that yieldably biases the head 18 into the passage 13. Thus, where the opening degree of the throttle valve 14 is controlled externally of the carburetor (A), the position of the head 18 is automatically adjusted internally and in accordance with the load of the engine.

With the application of a float-type fuel chamber 26, the cylinder bore 8 extends substantially vertically. Thepiston head 18 has a blind bore 18*c* with a cylindrical sidewall 18*b*. The vacuum chamber 5 is defined between a lid 2, a flexible diaphragm 3 and the piston head 18. The spring 4 is interposed between the lid 2 and the blind bore 18*c* of the piston head 18 and within the vacuum chamber 5. The spring 4 is held concentrically in place by a downward protrusion 2*a* formed in the lid 2 and the blind bore 18*c* of the piston head 18. The diaphragm 3 is substantially annular in shape having an inward perimeter or peripheral edge 3*a* fastened to an upper end of the cup shaped piston head 18 via a pair of upper and lower retaining washers 9 engaged concentrically to an upper edge head 18. An outer peripheral edge 3*b* of the diaphragm 3 is fastened sealably between an upper portion of the carburetor body 6 and the lid 2. The retaining washers 9 lie within an imaginary plane disposed substantially perpendicular to a centerline of the cylinder bore 8. The washers 9 engage an upward facing surface of the body 6 when the head 18 protrudes to a maximum degree into the fuel-and-air mixing passage 13.

The vacuum chamber 5 is defined above the diaphragm 3, and an atmospheric chamber 10 is disposed below the vacuum pressure chamber 5 and defined between the diaphragm 3 and the carburetor body 6. As the head 18 moves upward within the cylinder bore 8, the inner peripheral edge 3*a* moves upward causing the diaphragm 3 to flex. The atmospheric chamber 10 is exposed to filtered atmosphere via an atmospheric passage 12 which communicates with the fuel-and-air mixing passage 13 at the inlet 13*a*, just downstream of the air filter (not shown).

The fuel regulating needle 20 projects rigidly downward from the bottom portion 18*a* of the piston head 18 into a main fuel feed tube 28 which extends through the body 6 and projects slightly upward into the fuel-and-air mixing passage 13 from a bottom portion 26*a* of the float chamber 26. The upper end of the fuel regulating needle 20 is supported by a support 7 engaged to the surface 18*b* of the bottom portion 18*a* of the head 18. The feed tube 28 defines a fuel feed passage 28*a* which communicates between the fuel-and-air mixing passage 13 beneath the head 18 and the fuel chamber 26 when the needle 20 is not fully inserted to its maximum degree into the passage 28*a*. That is, as the piston head 18 moves, the regulating needle 20 moves into or partially out of the main fuel feed tube 28 thereby controlling the amount of a rich fuel-and-air mixture entering the fuel-and-air passage 13. Engaged to a bottom end of the main fuel feed tube 28 is a fuel jet 27.

An upper and lower portion 28*c*, 28*d* of the main fuel tube 28 are engaged circumferentially and sealably to the carburetor body 6. Located between the engagements of the upper and lower portions 28*c*, 28*d* to the body 6 is an axial extending substantially annular air pocket 28*e* defined substantially radially between the fuel feed tube 28 and body 6. The annular pocket 28*e* communicates with an air inlet port 28*f* disposed at or near the inlet 13*a* of the fuel-and-air mixing passage 13 to supply filtered air at or near atmospheric pressure to the pocket 28*e*. The air from the annular pocket 28*e* enters a mid portion of the main fuel supply tube 28 via a series of diametrically opposed apertures spaced axially along the tube 28. This air mixes with fuel traveling through the fuel jet 27 into the feed passage or pre-mixing chamber 28*a* thereby supplying a rich fuel-and-air mixture through a radial clearance 28*g* into the fuel-and-air mixing passage 13 at high engine RPM running or load conditions when the throttle is at least partially open.

The regulating needle 20 tapers radially inward as it projects axially outward from the bottom portion 18*a* of the piston head 18. When the head 18 is fully inserted into the fuel-and-air mixing passage 13, the upper portion 28*c* of the main fuel feed tube 28 is engaged slideably and sealably to a short untapered cylindrical surface portion of the needle 20. This prevents any rich mixture of fuel-and-air from flowing into the fuel-and-air mixing passage 13 at the venturi location at engine idle. During hot idle conditions the engine must therefore rely on all fuel entering the carburetor via the fuel idle nozzle 16. With the head 18 partially or fully retracted during high vacuum conditions, a varying radial clearance 28*g* defined between the upper portion 28*c* of the main fuel feed tube 28 and the tapered portion of the regulating needle 20 is created allowing a rich mixture of fuel-and-air to flow from the pre-mixing chamber 28*a* into the fuel and air mixing passage 13. Also, as the needle 20 moves upward, a greater number of apertures 28*d* are exposed to the volumetrically increasing pre-mixing chamber 28*a* which further increases the flow of the rich fuel-and-air mixture.

Because a cold engine requires a richer mixture of fuel-and-air to reliably start, the liquid fuel flow from the fuel idle nozzle 16 disposed near the throttle valve during cold start conditions of the engine is not sufficient. Consequently, a fuel priming device 41 is integrated into the variable venturi carburetor (A). It should also be noted that the device 41 will assist in the smooth acceleration of a cold engine just after start for similar reasons. Device 41 has an isolation valve 41*a*, an inlet passage 32 which extends from the bottom portion 26*a* of the float chamber 26 within the approximate vicinity of the fuel jet 27 of the main fuel feed tube 28, and an outlet passage 33 which communicates between the isolation valve 41*a* and a cold idle fuel nozzle 21 disposed at or near the venturi location just upstream of the main fuel feed tube 28 thereby promoting liquid fuel flow via differential pressure. The cold idle fuel nozzle 21 is disposed under the piston head bottom 18*a* in the fuel-and-air mixing passage 13 because it is at this venturi location that the strongest vacuum exists, necessary for flowing fuel through the nozzle 21.

The isolation valve 41*a* is an electromagnetic or electric solenoid valve having a valve body integral with a plunger 43 inserted into a electromagnetic coil 42. The plunger 43 is biased by the force of a spring 45 toward an outlet port 41*b* on the end wall of a valve chamber 44 defined by the valve body 6. An outlet orifice 41*c* is located on and communicates through a peripheral wall of the valve body to the inlet passage 32. The electromagnetic coil 42 is connected or powered by a supply battery or direct current power source 47 via a thermal switch 46. The thermal switch 46 comprises a thermal tap or temperature sensor disposed for example on a wall of the engine (not shown) in order to close the device circuit when the temperature of the engine wall is below a fixed or preset value. In this manner, the isolation valve 41*a* is open so that fuel is drawn out by the air intake vacuum of the venturi portion of the fuel-and-air mixing passage 13 only when engine temperatures are below a preset value.

During operation, when the electromagnetic coil 42 of the isolation valve 41*a* is energized just after the engine is started, and at low temperatures, the valve body or plunger 43 is forced against and overcomes the resilience of the spring 45 in order to open the passage 33. Once open, the liquid fuel from the fuel chamber 26 flows into the fuel nozzle 21 via the passages 32 and 33. The quantity of fuel flowing into the variable venturi portion thereby increases and a richer mixture is supplied to the engine, thus stabilizing idling and accelerating properties of a cold running engine.

Figure 3:
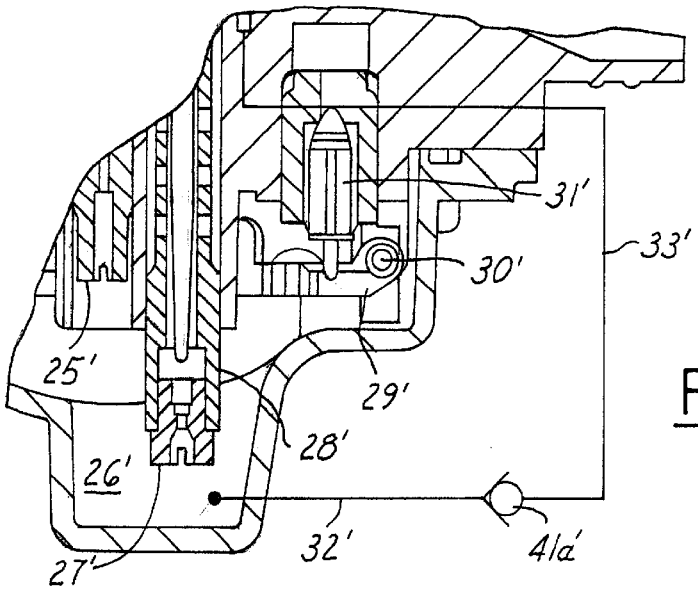
FIG. 3 is a partial diagrammatic and a fragmentary sectional view of a second embodiment of the variable venturi carburetor illustrating a cold-start fuel priming device.
Figure 4:
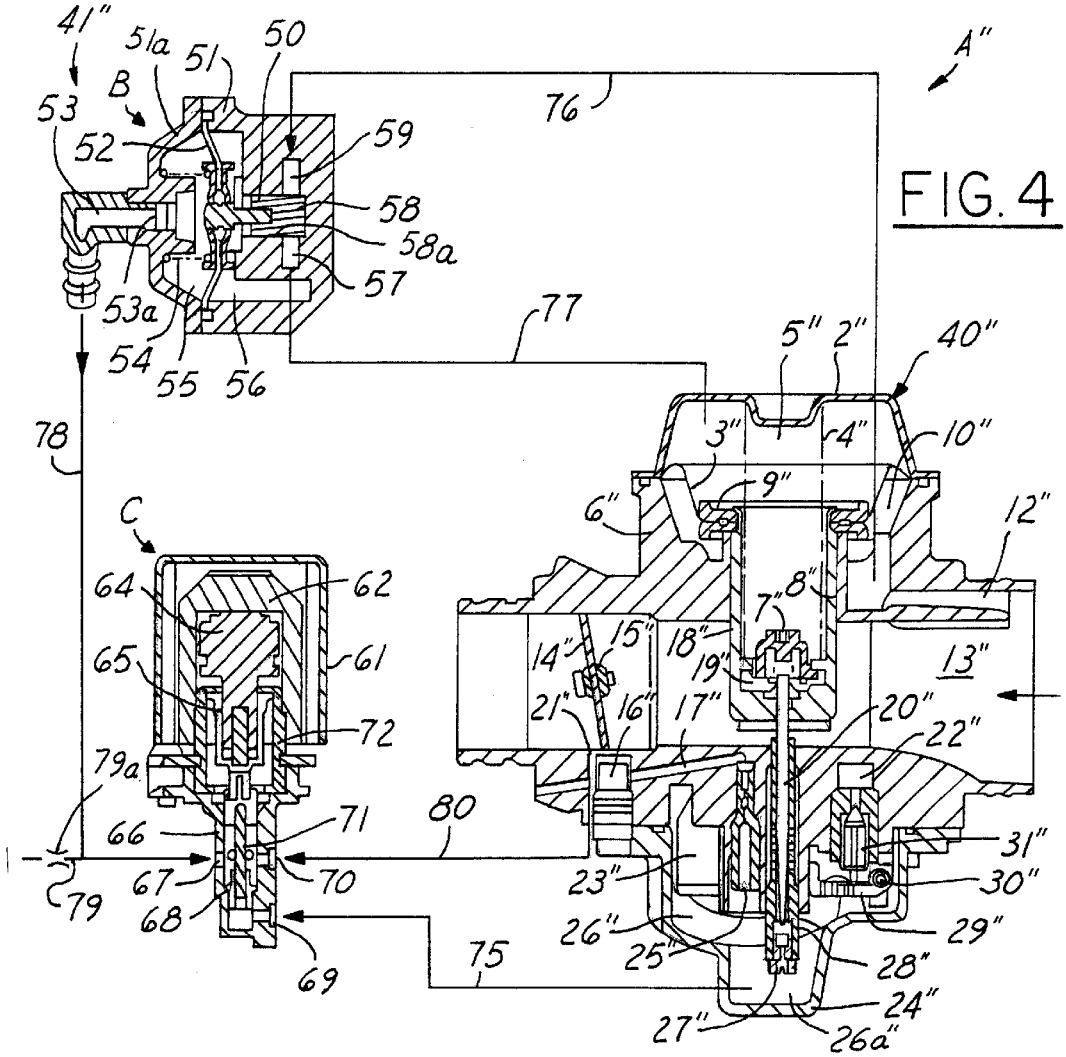
FIG. 4 is a part diagrammatic and a side sectional view of a third embodiment of the variable venturi carburetor.
Figure 5:
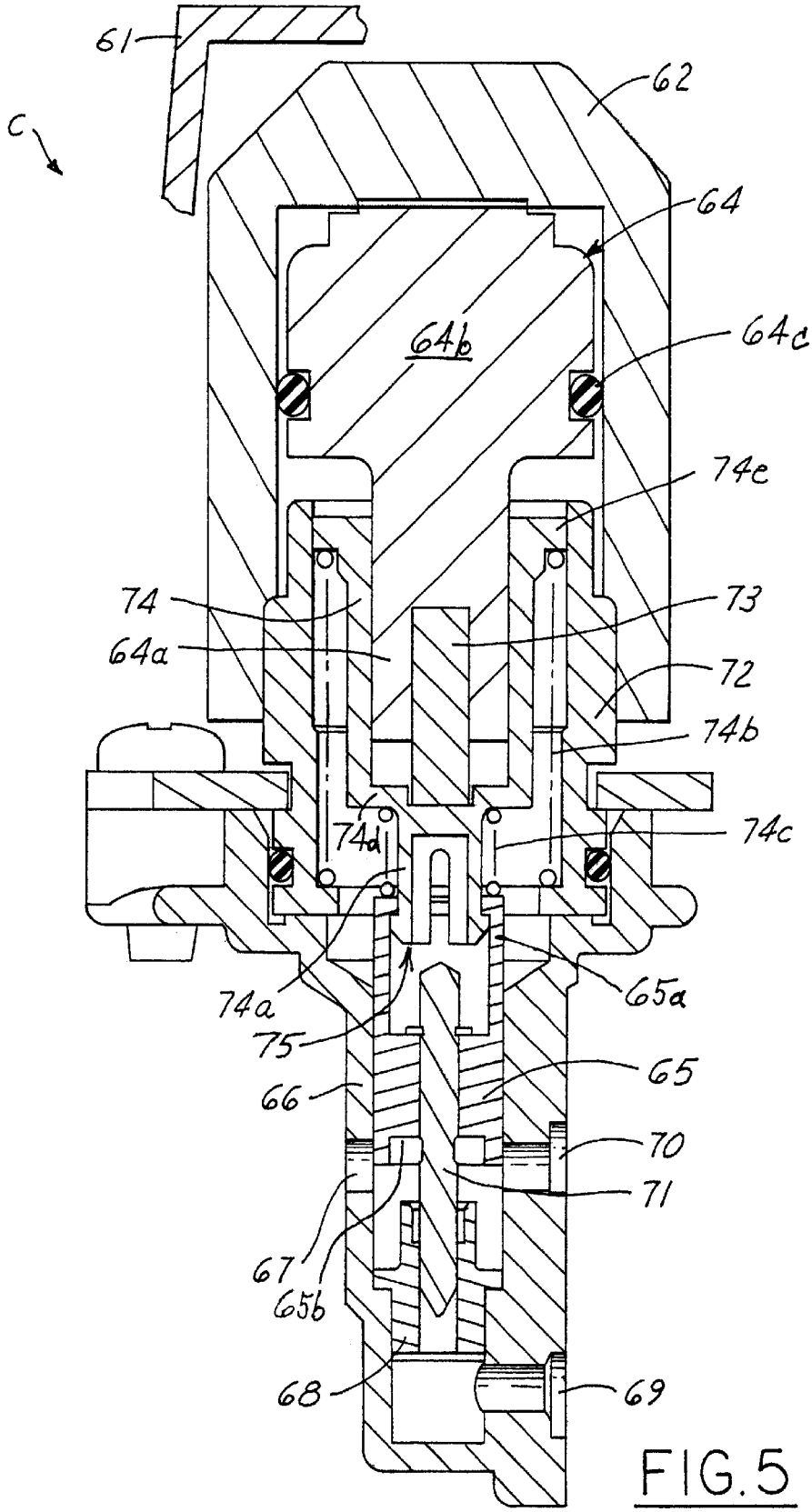
FIG. 5 is an enlarged section view of a fuel-and-air mixture isolation valve of the variable venturi carburetor of FIG. 4.

Referring to FIG 3, a partial illustration of a second embodiment of the variable venturi carburetor (A') is shown. The electromagnetic isolation valve 41*a* of the first embodiment is replaced with a check valve 41*a*' of the second embodiment. The check valve 41*a*' can only open upon a strong air intake vacuum communicated from a venture of a fuel-and-air mixing passage, exposed via a fuel nozzle and disposed under a piston head. Such a strong vacuum will exist when the head is extended fully into passage, and not when it is retracted.

As shown best in FIG'S 4 and 5, a third embodiment of the present invention is illustrated. A cold-start fuel priming device 41" delivers a rich mixture of fuel-and-air just downstream of the throttle valve 14" within the fuel-and-air mixing passage 13" when the engine is cold, and at idle or initial acceleration. The priming device 41" has a master rich fuel-and-air mixture isolation valve (C) and a dual functioning air isolation or bypass valve (B) which is slave to the mixture isolation valve (C). Priming device 41" is triggered by engine temperature acting on the mixture isolation valve (C) which has a heat sensitive element 64 which expands above a pre-established value thereby closing the valve. Likewise, the element 64 contracts when temperatures fall below the pre-established value, and the valve opens. When valve (C) is open (i.e. engine is cold) and the engine is running at idle (i.e. throttle valve 14" is closed), a vacuum pressure is sensed from passage 13" and through the open master valve (C) that acts on the slave air bypass valve (B). This acting vacuum pressure causes a diaphragm 52 within slave bypass valve (B) to flex, opening the normally closed bypass valve (B) against the resilient force of a spring 54 exerted against the diaphragm 52. When open, the vacuum pressure chamber 5" of the carburetor (A) is caused to communicate directly with the atmosphere chamber 10" reducing the differential pressure across the diaphragm 3". With the reduction in differential pressure, the resilient force of spring 4" is capable of pushing the head 18" into the passage 13" enabling the needle 71 to isolate or close-off the substantially lower fuel-and-air mixture flow originating from the fuel feed passage 28*a*". Consequently, until the cold engine heats up, fuel and some air is supplied to the operating engine solely or substantially from the master isolation valve (C). During this time, the main fuel feed passage 28*a*" is inactive. Accordingly, cold engine idling is stabilized, and even initial cold engine acceleration is made smooth since the primary device 41" is functioning.

The master isolation valve (C) receives liquid fuel via a fuel inlet conduit 75 communicating between the valve (C) and a lower portion 26*a*" of the fuel chamber 26". A portion of the combustible air flows to an air port 67 carried by valve (C) via an air supply conduit 79 which communicates between a filtered air source at substantially atmospheric pressure and the air port 67. Preferably, inlet 13*a*" is an ideal air source, being filtered and near atmospheric pressure. An air operating conduit 78 communicates between an operating chamber 55 of the slave valve (B) and a portion of the air supply conduit 79 located between the master valve (C) and a reduction orifice 79*a* carried by the conduit 79. The reduction orifice 79*a* assures enough vacuum draw through air operating conduit 78 to open the slave valve (B).

The air operating chamber 55 is defined between one side (left as illustrated) of the diaphragm 52 and a lid 51*a* engaged along the diaphragm's perimeter to a valve body 51. An atmospheric or reference chamber 56 is defined between an opposite side of the diaphragm 52 and the valve body 51. The perimeter of the diaphragm 52 is engaged and sealed between the lid 51*a* and the valve body 51. A valve head 58 is engaged to the approximate center of the diaphragm 52 and projects through the reference chamber 56 and into a blind bore or bypass chamber 58*a* carried by the valve body 51.

Communicating with the bypass chamber 58*a* is an inlet port 59 and a diametrically opposed outlet port 57. The inlet port 59 communicates with the atmosphere chamber 10" of the carburetor (A") via an atmospheric conduit 76, and the outlet port 57 communicates with the vacuum chamber 5" via a vacuum conduit 77.

When the valve head 58 is seated within the bypass chamber 58*a* by the biasing force of spring 54, the atmospheric conduit 76 is isolated from the vacuum conduit 77. However, when a vacuum exists within operating chamber 55 sufficient to overcome the spring 54 resilience, the diaphragm flexes into the operating chamber 55 and simultaneously moves the valve head 58, to a degree, out of the bypass chamber 58*a* so that the ports 57 and 59 are exposed to one-another and the conduits 76 and 77 communicate. Consequently, the vacuum chamber 5" loses vacuum and the piston 18" moves to project further into the fuel-and-air mixing passage 13" shutting off fuel flow through the fuel feed passage 28" via the needle 20".

When master valve (C) is open, liquid fuel enters valve (C) via a fuel conduit 75 through a fuel port 69 carried by lower housing 66. The fuel then mixes with air entering via the air supply conduit 79 and through port 67 carried by lower housing 66 and is thus delivered to the fuel-and-air mixing passage 13" just downstream of the throttle valve 14" via a rich mixture conduit 80 which extends between the fuel port 69 and a nozzle 21" disposed in the passage 13". After the engine sufficiently warms the heat sensitive element 64 expands closing the fuel-and-air mixture isolation valve (C). This closure stops any fuel-and-air mixture flow through the mixture conduit 80, closes valve (B) which restores vacuum in chamber 5" causing the piston 18" to retract which begins fuel flow through the fuel feed passage 28".

The heat sensitive element 64 of the mixture isolation valve (C) is mushroom shaped and volumetrically expands when heated by the operating engine. Element 64 is housed within and engaged against the bottom of an inverted blind bore carried by an upper housing 62 disposed above and inter-engaged to the lower housing 66. A stem or piston 64*a* extends unitarily and concentrically downward from and enlarged head 64*b* of the mushroom shaped heat sensitive member 64 and fits into a tube or cylinder 74. The cylinder 74 fits into a tube 72 disposed radially inward from and engaged circumferentially to a lower end of the upper housing 62. A rod 73 is embedded within and protrudes concentrically downward from the piston 64*a* within the cylinder 74 and contacts an upward facing bottom surface of the cylinder 74.

The heat sensitive member 64 is biased upward against the upper housing 62 as the cylinder 74 is forced upward against the rod 73 by a coiled primary spring 74*b*. The primary spring 74*b* is interposed radially between the cylinder 74 and the tube 72 and axially compressible between a radially outward projecting rim 74*e* of the cylinder 74 and a bottom radially inward projecting rim 72*a* of the tube 72. A radial clearance between the contracted head 64*b* and the upper housing 62 permits radial expansion of the head 64*b* when heated. A resilient o-ring 64*c* seats within a circumferential channel of the enlarged head 64*b* and spans the radial clearance to contact the upper housing 62 thereby centering the heat sensitive element with respect to the upper housing 62. The radial distance of the clearance is sufficient enough to permit radial expansion of the enlarged head 64*b* when heated. The o-ring is capable of compressing accordingly between the head 64*b* and upper housing 62 so that the head expansion does not damage or distort the housing 62.

A hollow rod 74*a* extends unitarily and concentrically downward from an enlarged flange bottom 74*d* of the cylinder 74 and is connected via a loss motion coupling 75 to an upper hollow part 65*a* of a secondary piston 65 fitted slideably into the lower housing 66 generally below the tube 72. The housing 66 interconnects rigidly to the housing 62 via the tube 72 preventing axial slipage. The hollow rod 74*a* is urged in a direction away from the piston 65 by the force of a secondary coil spring 74*c*. A needle 71 supported rigidly on the secondary piston 65 inserts concentrically into a fuel nozzle 68 fitted into and circumferentially sealed to the lower part of the valve housing 66. The peripheral wall of the lower housing 66 carries the air port 67 of conduit 76 and the mixture port 70 of conduit 80. The air port 67 is substantially opposed diametrically to the mixture port 70 of the mixture conduit 80. A lower end of the lower housing 66 disposed axially below the nozzle 68 carries the fuel port 69 of the liquid fuel conduit 75.

As the heat sensitive member 64 heats and therefore expands axially the primary spring 74*b* compresses as cylinder 74 moves axially downward carrying hollow rod 74*a*, the secondary spring 74*c*, the secondary piston 65 and the needle 71 with it. Because the frictional resistance radially between the adjacent lower housing 66 and the secondary piston 65, and radially between the needle 71 and the nozzle 68, are minimal relative to the compression resistance or force of the secondary spring 74*c*, the secondary spring 74*c* compression is zero or minimal and the hollow rod 74*a* remains in direct axial contact or near contact with the secondary piston 65. In other words, it is not until the needle 71 is fully inserted into the nozzle 68 that any axial motion of the heat sensitive element 64 is lost within the loss motion coupling 75.

When the needle 71 is fully inserted into the nozzle 68, thereby blocking all fuel flow, and an annular bottom 65*b* of the secondary piston 65 seats against the top of the nozzle 68, the secondary spring 74*a* will begin to compress if the heat sensitive member 64 continues to expand axially thereby producing a lost axial motion in the coupling 75. Should this occur, the hollow rod 74*a* moves axially with respect to the now stationary secondary piston 65, inserting further into the hollow portion 65*a*. In this way, the secondary spring 74*c* protects the valve (C) from thermal expansion damage.

In operation, and when cranking the cold engine, strong vacuum exerts on the nozzle 21". Furthermore, mixture isolation valve (C) is open because the heat sensitive element 64 is in the contracted state, so that the cylinder 74, the piston 64*a* and the piston 65 are pushed up by the force of the primary spring 74*b*, and the air port 67, the fuel port 69 and the mixture port 70 are communicated with one another via the housing. Accordingly, air in the operating chamber 55 of the bypass valve (B) is sucked into the lower housing 66 via the orifice 53*a*, the outlet 53, the conduit 78, the conduit 79, and the air port 67, whereby the valve head 58 of the bypass valve (B) retracts and opens against the force of the spring 54.

Within the mixture isolation valve (C), liquid fuel in the fuel chamber 26" is sucked or flows into the lower housing 66 via the fuel conduit 75 and the fuel inlet port 69. The liquid fuel from the fuel nozzle 68 is mixed with air incoming from port 67 and the rich mixture is ultimately supplied to the engine via the mixture port 70, the mixture conduit 80, the nozzle 21" and the fuel-and-air mixing passage 13". Accordingly, engine idling is stabilized during the cold-start. Even the fuel-and-air mixing passage opening degree of the butterfly type throttle valve 14" is made large to some extent during warming up of the engine, the smooth acceleration can be obtained since the rich mixture isolation valve (C) is in operation.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention as defined by the following claims.

What is claimed is:

1. A variable venturi carburetor of a combustion engine having a body defining a fuel-and-air mixing passage communicating through the body between an inlet and an outlet, a fuel chamber carried by the body, and a throttle valve disposed within the fuel-and-air mixing passage, the variable venturi carburetor comprising:

a wall of the body defining a bore communicating with the fuel-and-air mixing passage between the throttle valve and the inlet of the fuel-and-air mixing passage;

a fuel feed passage communicating with the fuel-and-air mixing passage and opposed diametrically to the bore, the fuel feed passage communicating between the fuel-and-air mixing passage and the fuel chamber;

a vacuum chamber carried by the body;

an elongated piston head disposed slidably within the bore and projecting into the fuel-and-air mixing passage;

a needle projecting longitudinally from a bottom portion of the elongated piston head and into the fuel feed passage;

a vacuum passage extended through the bottom portion of the piston head and communicating between the fuel-and-air mixing passage and the vacuum chamber;

the fuel feed passage being defined by a fuel feed tube carried by the body, the fuel feed tube having an aperture extended laterally through the fuel feed tube and communicating between the fuel feed passage and air at atmospheric pressure;

a variable clearance of the fuel feed passage, the clearance defined laterally between the needle and the fuel feed tube and communicating between the fuel-and-air mixing passage and the fuel chamber, the clearance being zero or minimal in flow cross section when the piston head is inserted to a maximum degree into the fuel-and-air mixing passage and being at a maximum in flow cross section when the piston head is retracted to a full degree from the fuel-and-air mixing passage;

an air pocket defined laterally between the fuel feed tube and the carburetor body, the aperture communicating between the fuel feed passage and the air pocket, the air pocket being in communication with air at atmospheric pressure;

an air orifice disposed at the inlet of the fuel-and-air mixing passage, the orifice being in communication with the air pocket;

wherein the fuel feed passage has an upper and a lower portion both being engaged circumferentially sealably to the carburetor body, and wherein the air pocket is disposed axially between the upper and lower portions;

a diaphragm engaged between a peripheral edge of the piston head and the body;

a lid engaged to the carburetor body, the vacuum chamber defined between the lid, the diaphragm and the outward side of the piston head;

an atmospheric chamber defined between the opposite side of the diaphragm and the carburetor body;

an atmospheric passage carried by the carburetor body and communicating between the atmospheric chamber and the inlet of the fuel-and-air mixing passage;

a spring disposed within the vacuum chamber, the spring being constructed and arranged to bias the head to a maximum degree into the fuel-and-air mixing passage;

wherein the spring is engaged between the lid and the outward side of the piston head, the spring being compressed upon adequate vacuum in the fuel-and-air mixing passage near the piston head causing the piston head to retract laterally outward from the fuel-and-air mixing passage;

a sub-atmospheric fuel idle passage communicating between the fuel chamber and the fuel-and-air mixing passage via a fuel nozzle disposed in the fuel-and-air mixing passage near the fuel feed passage; and an isolation valve constructed and arranged to open the fuel idle passage when the engine is idling cold.

2. The variable venturi carburetor set forth in claim 1 wherein the isolation valve is electromagnetic which opens when the engine is started.

3. The variable venturi carburetor set forth in claim 2 comprising the isolation valve having a thermo-switch, whereby the switch controls the electric power to the isolation valve thereby closing the isolation valve when an upper preset engine temperature is reached.

4. The variable venturi carburetor set forth in claim 1 wherein the isolation valve is a biased closed check valve that opens upon a preset vacuum at the outlet.

5. The variable venturi carburetor set forth in claim 1 wherein the fuel nozzle of the sub-atmospheric fuel idle passage is diametrically opposed to the bore.

6. A variable venturi carburetor for a combustion engine comprising:

a body;

a fuel-and-air mixing passage carried by and extending through the body, the fuel-and-air mixing passage having an inlet and an outlet;

a fuel chamber carried by the body below the fuel-and-air mixing passage;

a wall of the body defining a cylinder bore communicating laterally with the fuel-and-air mixing passage;

a fuel feed passage communicating with the fuel-and-air mixing passage and disposed concentrically and opposed diametrically to the cylinder bore, the fuel feed passage communicating between the fuel-and-air mixing passage and the fuel chamber;

an elongated piston head disposed slidably within the cylinder bore and projecting into the fuel-and-air mixing passage, the piston head having an inward side exposed to the fuel-and-air mixing passage and being engaged sealably and slidably to the wall;

a needle projecting longitudinally from the inward side of the elongated piston head and into the fuel feed passage;

a clearance of the fuel feed passage defined radially between the body and the needle, the clearance communicating with the fuel-and-air mixing passage, wherein a flow cross section of the clearance varies with axial movement of the needle;

a fuel priming device having an isolation valve, a fuel inlet passage communicating directly between the fuel chamber and the isolation valve, and a sub-atmospheric fuel outlet passage communicating directly between the isolation valve and the fuel-and-air mixing passage via a fuel nozzle disposed in the fuel-and-air mixing passage near the fuel feed passage; and wherein the isolation valve is constructed and arranged to open when the engine is idling cold permitting fuel to flow from the near atmospheric fuel chamber to the sub-atmospheric fuel nozzle.

7. The variable venturi carburetor set forth in claim 6 wherein the isolation valve is electromagnetic which opens when the engine is started.

8. The variable venturi carburetor set forth in claim 7 comprising the isolation valve having a thermo-switch, whereby the switch controls the electric power to the isolation valve thereby closing the isolation valve when an upper preset engine temperature is reached.

9. The variable venturi carburetor set forth in claim 6 wherein the isolation valve is a biased closed check valve that opens upon a preset vacuum at the outlet.

10. The variable venturi carburetor set forth in claim 6 comprising:

a flexible diaphragm engaged radially between the body and the piston head;

a vacuum chamber;

an atmosphere chamber disposed below the vacuum chamber;

a diaphragm disposed between the vacuum chamber and the atmosphere chamber, the vacuum chamber being defined by an outward side of the piston head and the diaphragm; and a vacuum passage extended through the piston head and communicating between the fuel-and-air mixing passage beneath the piston head and the vacuum chamber.

* * * * *